United States Patent [19]

Pizzacar

[11] Patent Number: 5,003,640

[45] Date of Patent: Apr. 2, 1991

[54] ADVERTISING CAP NAMEPLATE

[76] Inventor: Anthony Pizzacar, 160 Greenway West, New Hyde Park, N.Y. 11040

[21] Appl. No.: 417,204

[22] Filed: Oct. 4, 1989

[51] Int. Cl.[5] ..... A42B 1/24

[52] U.S. Cl. ..... 2/199; 2/197; 2/185 R; 2/DIG. 6

[58] Field of Search ..... 2/174.4–174.8, 2/181, 181.2, 181.4, 182.1–182.7, 183, 184.5, 197, 209.3, 209.4, 199, 195, 185 R, DIG. 6; 40/329

[56] References Cited

U.S. PATENT DOCUMENTS

| | | | |
|---|---|---|---|
| 525,287 | 8/1894 | Ruth | 2/185 R |
| 676,293 | 6/1901 | Wright | 2/185 R |
| 1,294,595 | 2/1919 | Allen | 40/329 |
| 1,559,917 | 11/1925 | Schnebel | 2/183 |
| 1,808,966 | 6/1931 | Morgan | 2/181 |
| 2,181,446 | 11/1939 | Ames | 2/171.4 |
| 4,776,043 | 10/1988 | Coleman | 2/185 R |
| 4,872,218 | 10/1989 | Holt | 2/197 |
| 4,905,406 | 3/1990 | Warner | 2/199 |

FOREIGN PATENT DOCUMENTS

| | | | |
|---|---|---|---|
| 444667 | 6/1936 | United Kingdom | 2/185 R |

*Primary Examiner*—William A. Cuchlinski, Jr.
*Assistant Examiner*—Alvin Wirthlin
*Attorney, Agent, or Firm*—Michael I. Kroll

[57] ABSTRACT

An advertising cap for a user has a back, a headband, a pair of straps disposed at the back of the conventional cap for adjustment of the size of the headband of the conventional cap, an advertising cap nameplate for concealing the pair of straps after the headband of the conventional cap is adjusted, and structure for removably mounting the advertising cap nameplate so that the advertising cap nameplate may be changed depending upon the preference of the user.

8 Claims, 2 Drawing Sheets

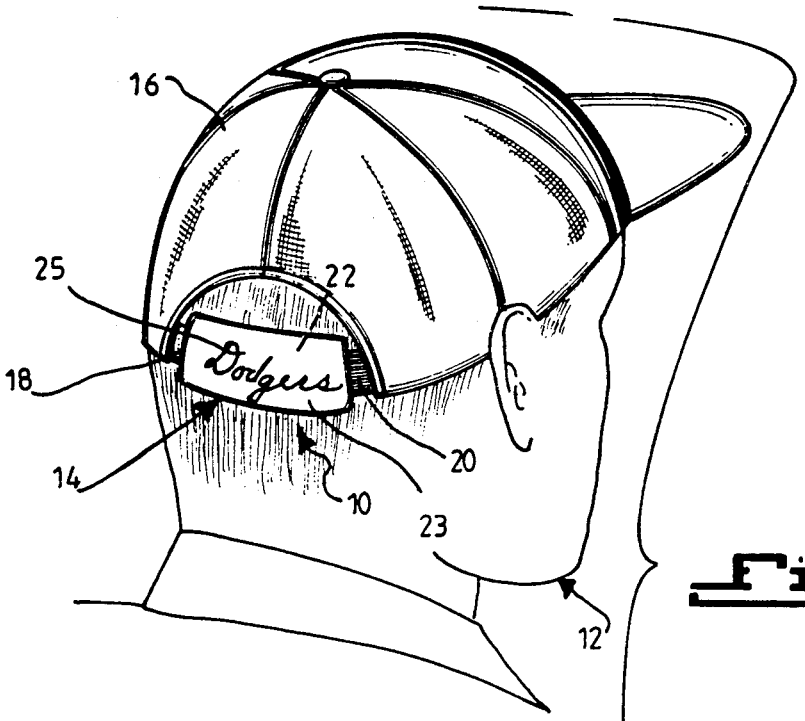
Fig. 1
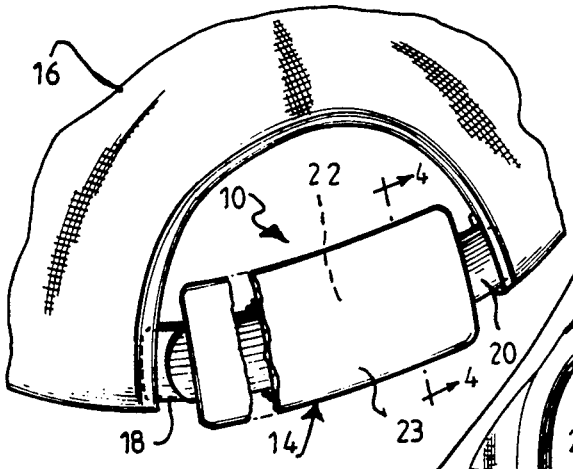
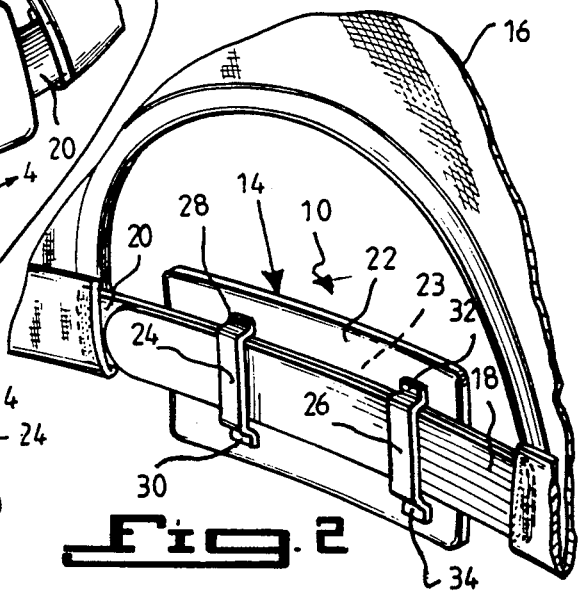
Fig. 2
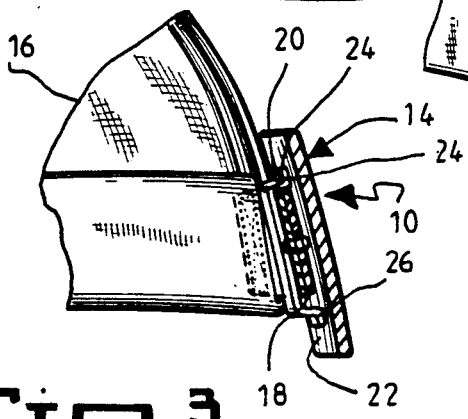
Fig. 3

ADVERTISING CAP NAMEPLATE

BACKGROUND OF THE INVENTION

1. Field of the Invention:

The present invention relates to a cap.

More particularly, the present invention relates to an advertising cap nameplate.

2. Description of the Prior Art:

Numerous innovations for caps have been provided in the prior art that are adapted to be used. Even though these innovations may be suitable for the specific individual purposes to which they address, they would not be suitable for the purposes of the present invention.

SUMMARY OF THE INVENTION

It is an object of the present invention to provide an advertising cap nameplate whose unsightly adjusting straps are covered by the advertising cap nameplate. The advertising cap nameplate can be used for advertising, children's names, etc, which can be applied by use of silk screening, stick ons, or handwriting.

In keeping with these objects, and with others which will become apparent hereinafter, one feature of the present invention resides, briefly stated, in an advertising cap for a user, including a conventional cap having a back, a headband, a pair of straps disposed at the back of the conventional cap for adjustment of the size of the headband of the conventional cap, wherein means for concealing the pair of straps after the headband of the conventional cap has been adjusted, and means for removably mounting the concealing means.

When the advertising cap is designed in accordance with the present invention, the concealing means may be changed depending upon the preference of the user.

In accordance with another feature of the present invention, the concealing means include an advertising cap nameplate having a back.

Another feature of the present invention is that the mounting means include a pair of raised mounting bars having ends that attach to the back of the advertising cap nameplate.

Yet another feature of the present invention is that the mounting means include a hook and loop fastener.

Still another feature of the present invention is that if further comprises a pair of projections extending from the back of the advertising cap nameplate so that the pair of projections rest on the adjustable straps and are prevented from falling.

Yet still another feature of the present invention is that the mounting means include holes in the advertising cap nameplate through which the projections of the adjustment straps pass.

Still yet another feature of the present invention is that the advertising cap nameplate can be printed upon during manufacturing.

Another feature of the present invention is that the advertising cap nameplate is blank and can be written upon by the user.

The novel features which are considered characteristic for the invention are set forth in particular in the appended claims. The invention itself, however, both as to its construction and its method of operation, together with additional objects and advantages thereof, will be best understood from the following description of the specific embodiments when read in connection with the accompanying drawing.

BRIEF DESCRIPTION OF THE DRAWING

FIG. 1 contains a perspective view of a user wearing a conventional cap with the advertising cap nameplate of the present invention printed and mounted over the cap's rear adjustment straps;

FIG. 2 is a perspective view of the conventional cap with the advertising cap nameplate of the present invention blank and having pieces broken away and being mounted over the cap adjustment straps;

FIG. 3 is a perspective view of the conventional cap shown inside out and revealing the rear side of the advertising cap nameplate of the present invention and which includes a pair of raised mounting bars fixedly attached at their ends to the rear side of the advertising cap nameplate and having the adjustment straps located through the pair of raised mounting bars; FIG. 4 is a cross-sectional view of the present invention taken along line 4—4 in FIG. 2;

LIST OF REFERENCE NUMERALS UTILIZED IN THE DRAWING

Figure 5:
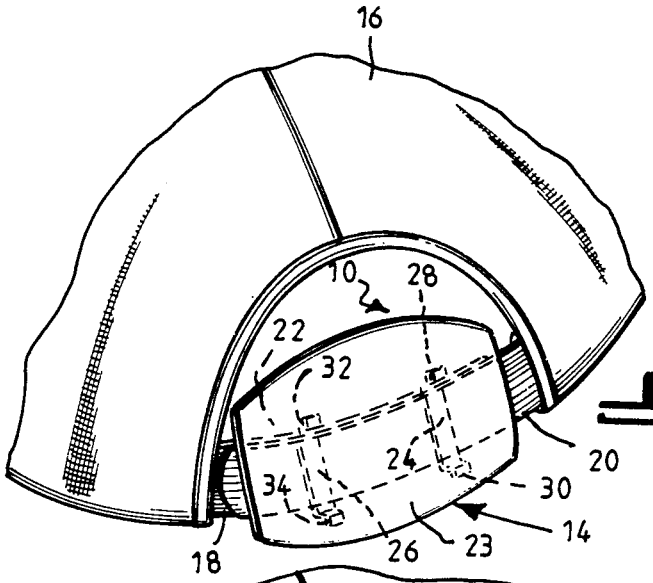
FIG. 5 is a perspective view, in partial phantom, of the conventional cap, which reveals the front side of the advertising cap nameplate of the present invention and shows a pair of raised mounting bars fixedly attached at their ends to the rear side of the advertising cap nameplate and having the adjustment straps, shown in phantom, located through the pair of raised mounting bars.

10—an advertising cap
12—a user wearing the advertising cap 10
14—advertising cap nameplate
16—a conventional cap
18—a conventional adjustment strap
20—another conventional adjustment strap
22—rear side of the advertising cap nameplate 14
23—front side of the advertising cap nameplate 14
24—a raised mounting bar
25—logo on front side of the advertising cap nameplate 14
26—another raised mounting bar
27—writing instrument
28—a fixed end of the raised mounting bar 24
30—another fixed end of the raised mounting bar 24
32—a fixed end of the raised mounting bar 26
34—another fixed end of the raised mounting bar 26
10'—alternate embodiment of the advertising cap 10
16'—conventional cap
18'—a conventional adjustment strap
20'—another conventional adjustment strap
28'—loop portion of fastener
30'—hook portion of fastener
32'—an upper projection
34'—another upper projection 10″—another alternate embodiment of the advertising cap 10
18″—an adjustment strap
20″—another adjustment strap
36″—a number of projections on the adjustment strap 20″
38″—holes in the adjustment strap 18″
39″—holses in the advertising cap nameplate 14″.

DETAILED DESCRIPTION OF THE PREFERRED EMBODIMENT

Referring now to FIG. 1, the advertising cap of the present invention is shown generally at 10, worn by a user 12, and advertising a logo 25 located on the advertising cap nameplate 14, which may take many different shapes and sizes.

The advertising cap 10 of the present invention includes a conventional cap 16 and conventional adjustable straps 18 and 20.

A blank advertising cap nameplate 14 of the present invention, is shown in FIG. 2.

In FIG. 3, the conventional cap 16 is turned inside out in order to gain a better view of the rear side 22 of the advertising cap nameplate 14.

A pair of raised mounting bars 24 and 26, have fixed ends 28 and 30, and 34, respectively, affixed to the rear side 22 of the advertising cap nameplate 14. The conventional adjustment straps 18 and 20 are both passed through the mounting bars 24 and 26 so as to affix the advertising cap nameplate 14, while properly adjusting the size of the cap 16 by use of the adjusting straps 18 and 20.

The configuration of the raised mounting bars 24 and 26, can be seen in detail in FIG. 4, where a cross sectional view is shown.

In FIG. 5, all of the pieces of the advertising cap 10 are shown relative to each other by the use of broken lines. The pair of raised mounting bars 24 and 26, shown in phantom, have fixed ends 28 and 30, and 32 and 34, respectively, affixed to the rear side 22 of the advertising cap nameplate 14. The conventional adjustment straps 18 and 20, shown in phantom, are both passed through the mounting bars 24 and 26.

Figure 6:
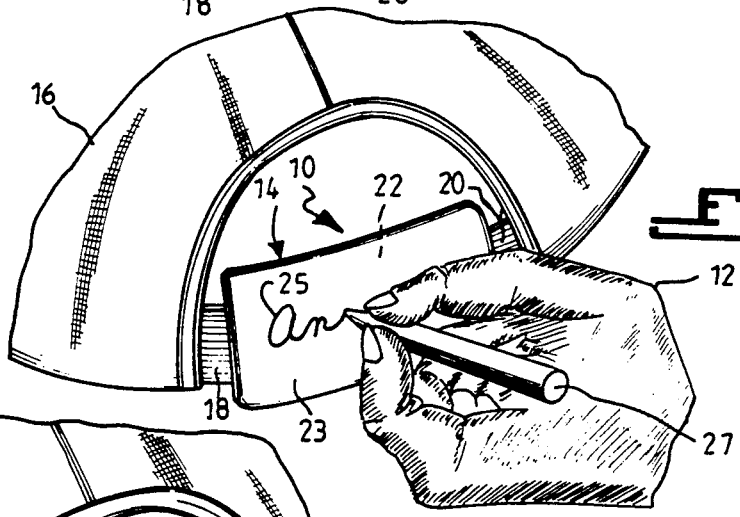
FIG. 6 is a perspective view of the user writing his own lexicography on the advertising cap nameplate of the present invention which is mounted to the conventional cap.

The user 12, in FIG. 6, is creating his own personal logo 25, by the use of a writing implement 27, on the front side 23 of the advertising cap nameplate 14. The front side 23 has been designed for this type of use and will therefore not damage the advertising cap nameplate 14 at all.

Figure 7:
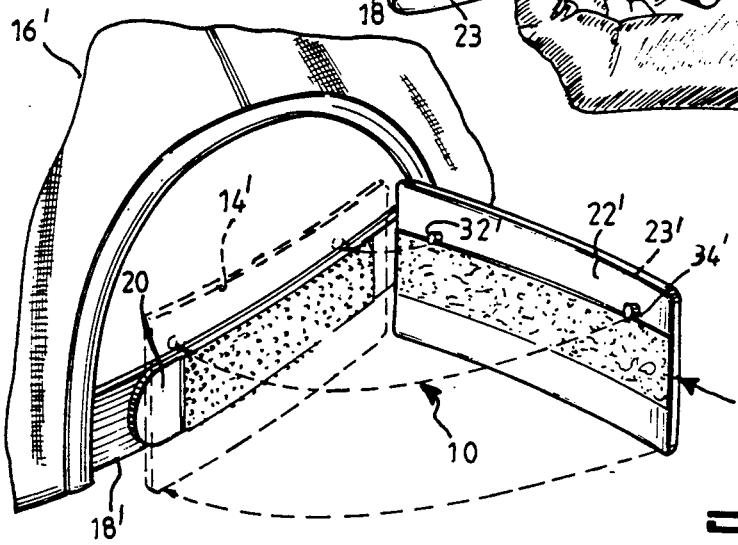
FIG. 7 is a perspective view of a first alternate embodiment of the present invention where the present invention is affixed by a loop and hook type fastener to the conventional cap.
Figure 8:
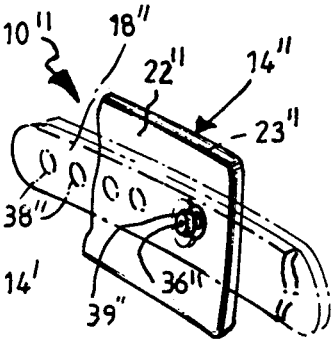
FIG. 8 is a perspective view of a second alternate embodiment of the present invention where the present invention is affixed, by utilizing the pins on the conventional cap to properly adjust the cap and provide a mounting means for attaching the present invention.

There are a number of other ways, as shown in FIGS. 7 and 8, to attach the advertising cap nameplate 14 to the straps 18 and 20.

For example, FIG. 7, shows an alternate embodiment 10′ of the present invention. The adjustment straps 18′ and 20′ are fixedly attached to each other in the way of a conventional cap 16′. A loop 28′ and hook 30′ fastener is used. The loop portion 28′ is fixedly attached to the adjustment strap 20′. The hook portion 30′ is fixedly attached to the rear side 22′ of the adjustment plate 14′.

In order to keep the loop 28′ and hook 30′ connected in line with the adjustment straps 18′ and 20′, a pair of upper projections 32′ and 34′ are provided which rest on top of the adjustment straps 18′ and 20′ and keep the effects of gravity at a minimum.

Another example, FIG. 8, shows another alternate embodiment 10″ of the present invention. The adjustment straps 18″ and 20″ are fixedly attached to each other in the way of the conventional cap (not shown). The strap 20″ contains a number of projection 36″ on the adjustment strap 20″ enter holes 38″ in the adjustment strap 18″ until the proper head band adjustment is achieved. When the proper head band adjustment is achieved, the projections 36″ of the adjustment strap 20″ enter the holes 38″ in the adjustment strap 18″ and ultimately, enter the holes 39″ in the advertising plate 10″.

It will be understood that each of the elements described above, or two or more together, may also find a useful application in other types of constructions differing from the type described above.

While the invention has been illustrated and described as embodied in a advertising cap, it is not intended to be limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. An advertising cap for a user, comprising:
(a) a conventional cap having a back, and a headband;
(b) a pair of straps disposed at said back of said conventional cap for adjustment of the size of said headband of said conventional cap, said pair of straps having tops;
(c) means for substantially concealing said pair of straps after said headband of said conventional cap is adjusted, said means for substantially concealing said pair of straps being mounted directly over said pair of straps which are now concealed;
(d) means for removably mounting said concealing means so that said concealing means may be changed depending upon the preference of the user; and
(e) means for advertising being disposed directly onto said concealing means.

2. An advertising cap as defined in claim 1, wherein said concealing means include an advertising plate having a front for displaying said advertising and a back.

3. An advertising cap as defined in claim 2, wherein said mounting means include a pair of raised mounting bars having ends that attach to said back of said advertising plate.

4. An advertising cap as defined in claim 2, wherein said mounting means include a hook and loop fastener sold under the tradename VELCRO ®.

5. An advertising cap as defined in claim 4, further comprising a pair of projections extending from said back of said advertising plate so that said pair of projections rest on the tops of said pair of straps to prevent said advertising plate from falling.

6. An advertising cap as defined in claim 2, wherein said mounting means include holes in said advertising plate through which projections on one of said pair of straps pass and hold thereon.

7. An advertising cap as defined in claim 2, wherein the front of said advertising plate is blank during manufacturing.

8. An advertising cap as defined in claim 7, wherein the front of said advertising plate is written upon by the user.

* * * * *

US005003640B1

REEXAMINATION CERTIFICATE (3105th)

United States Patent [19] [11] B1 5,003,640

Pizzacar [45] Certificate Issued Jan. 14, 1997

[54] ADVERTISING CAP NAMEPLATE

[76] Inventor: Anthony Pizzacar, 160 Greenway West, New Hyde Park, N.Y. 11040

Reexamination Request:
No. 90/003,609, Oct. 19, 1994

Reexamination Certificate for:

| | |
|---|---|
| Patent No.: | **5,003,640** |
| Issued: | **Apr. 2, 1991** |
| Appl. No.: | **417,204** |
| Filed: | **Oct. 4, 1989** |

[51] Int. Cl.[6] ..... A42B 1/24

[52] U.S. Cl. ..... 2/209.13; 2/181.4; 2/195.2; 40/329

[58] Field of Search ..... 2/171, 181, 181.2, 2/181.4, 195.1, 195.2, 195.3, 195.4, 209.11, 209.12, 209.13, 909, 918, DIG. 11; 24/697.1; 40/329, 586, 668, 669

[56] References Cited

U.S. PATENT DOCUMENTS

| | | |
|---|---|---|
| Re. 15,815 | 4/1924 | Trau . |
| Re. 33,430 | 11/1990 | Nunnery . |
| 153,007 | 7/1924 | Rosenzweig . |
| 1,498,505 | 6/1924 | Buchanan . |
| 1,663,124 | 3/1928 | Fischer . |
| 1,738,638 | 12/1929 | Carlson . |
| 1,764,505 | 6/1930 | Carlson . |
| 1,837,695 | 12/1931 | Werner . |
| 1,947,480 | 2/1934 | Meyer . |
| 2,160,567 | 5/1939 | Sterne . |
| 2,340,980 | 2/1944 | Ostolaza . |
| 2,447,850 | 8/1948 | Feldman . |
| 2,557,663 | 6/1951 | Knode . |
| 3,484,974 | 12/1969 | Culmone . |
| 3,848,270 | 11/1974 | Rand . |
| 4,274,160 | 6/1981 | Bloom . |
| 4,481,681 | 11/1984 | Hankin . |
| 4,521,922 | 6/1985 | Mitchell . |
| 4,611,355 | 9/1986 | Galanto . |
| 4,872,218 | 10/1989 | Holt ..... 2/171.5 |
| 4,873,726 | 10/1989 | Tapia . |
| 4,918,758 | 4/1990 | Rendina . |
| 4,941,210 | 7/1990 | Konucik . |

FOREIGN PATENT DOCUMENTS

| | | |
|---|---|---|
| 124654 | 4/1919 | United Kingdom . |
| 352322 | 7/1931 | United Kingdom . |

*Primary Examiner*—Diana Biefeld

[57] ABSTRACT

An advertising cap for a user has a back, a headband, a pair of straps disposed at the back of the conventional cap for adjustment of the size of the headband of the conventional cap, an advertising cap nameplate for concealing the pair of straps after the headband of the conventional cap is adjusted, and structure for removably mounting the advertising cap nameplate so that the advertising cap nameplate may be changed depending upon the preference of the user.

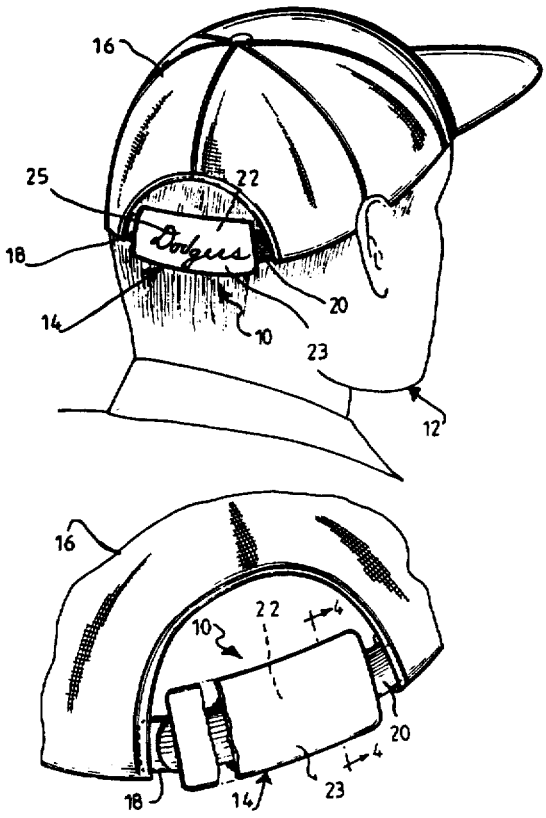

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1 and 2 are determined to be patentable as amended.

Claims 3–8, dependent on an amended claim, are determined to be patentable.

1. An advertising cap for a user, comprising:

(a) a conventional cap having a back[,] *with an opening therethrough,* and a headband;

(b) a pair of straps disposed at said back of said conventional cap for adjustment of the size of said headband of said conventional cap, said pair of straps having tops *and defining a lower boundary of said opening through the back of said conventional cap above said pair of straps*;

(c) means for substantially concealing said pair of straps after said headband of said conventional cap is adjusted, said means for substantially concealing said pair of straps being mounted directly over said pair of straps which are now concealed[;], *said means for substantially concealing having a shape that is less than the area of said opening in the back of said conventional cap, thereby leaving said opening substantially uncovered;*

(d) means for removably mounting said concealing means so that said concealing means may be changed depending upon the preference of the user; and (e) means for advertising being disposed directly onto said concealing means.

2. An advertising cap as defined in claim 1, wherein said concealing means include an advertising plate having a front [for] displaying said advertising and a back.

* * * * *